US008939254B2

(12) United States Patent
Schmitt et al.

(10) Patent No.: US 8,939,254 B2
(45) Date of Patent: Jan. 27, 2015

(54) MUFFLER UNIT

(71) Applicant: J. Eberspächer GmbH & Co. KG, Esslingen (DE)

(72) Inventors: Markus Schmitt, Muchweiler (DE); Michael Schmidt, Friedrichsthal (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 0 days.

(21) Appl. No.: 13/835,796

(22) Filed: Mar. 15, 2013

(65) Prior Publication Data

US 2013/0240289 A1 Sep. 19, 2013

(30) Foreign Application Priority Data

Mar. 15, 2012 (DE) ..... 10 2012 204 114

(51) Int. Cl.
*F01N 13/08* (2010.01)

(52) U.S. Cl.
USPC ..... 181/228; 181/282

(58) Field of Classification Search
CPC ..... F01N 1/02; F01N 13/08; F01N 13/1872; F01N 13/1888
USPC ..... 181/228, 282
See application file for complete search history.

(56) References Cited

U.S. PATENT DOCUMENTS

| | | | | | |
|---|---|---|---|---|---|
| 4,821,840 | A | * | 4/1989 | Harwood et al. | 181/282 |
| 4,905,791 | A | * | 3/1990 | Garey | 181/282 |
| 4,909,348 | A | * | 3/1990 | Harwood et al. | 181/282 |
| 4,958,701 | A | * | 9/1990 | Moring, III | 181/282 |
| 4,993,513 | A | | 2/1991 | Inone et al. | |
| 5,004,069 | A | * | 4/1991 | Van Blaircum et al. | 181/282 |
| 5,428,194 | A | * | 6/1995 | Emrick et al. | 181/228 |
| 6,135,237 | A | * | 10/2000 | Allman | 181/282 |
| 2002/0066619 | A1 | * | 6/2002 | Collmer et al. | 181/251 |
| 2009/0014236 | A1 | | 1/2009 | Van De Flier et al. | |

FOREIGN PATENT DOCUMENTS

| | | | |
|---|---|---|---|
| EP | 0 337 877 | A1 | 10/1989 |
| EP | 1 691 050 | A1 | 8/2006 |
| EP | 16 91 050 | A1 | 8/2006 |
| JP | S59-30516 | U | 2/1984 |
| JP | 2009-533601 | A | 9/2009 |
| JP | 2009-243388 | A | 10/2009 |
| WO | 2008/073137 | A1 | 6/2008 |

* cited by examiner

*Primary Examiner* — Forrest M Phillips
(74) *Attorney, Agent, or Firm* — McGlew and Tuttle, P.C.

(57) ABSTRACT

A muffler unit (1), especially for a motor vehicle, has a two-part housing (4) with first and second housing parts (2, 3) each of a shell-like design. An outlet opening and an inlet opening (5, 6) are provided in the housing (4). An outlet bottom (12) and an inlet bottom (13) are inserted into outlet opening (5) and into the inlet opening (6), respectively. The outlet bottom (12) and inlet bottom (13) are designed each as a cover that can be inserted into outlet opening (5) and inlet opening (6).

20 Claims, 2 Drawing Sheets

MUFFLER UNIT

CROSS REFERENCE TO RELATED APPLICATIONS

This application claims the benefit of priority under 35 U.S.C. §119 of German Patent Application DE 10 2012 204 114.1 filed Mar. 15, 2012, the entire contents of which are incorporated herein by reference.

FIELD OF THE INVENTION

The present invention pertains to a muffler unit (also known as a silencer unit), especially for a motor vehicle. The present invention pertains, furthermore, to an exhaust system for a motor vehicle.

BACKGROUND OF THE INVENTION

Conventional muffler units usually have an essentially tubular housing with an upper shell and a lower shell, which housing forms a gas-tightly closed cavity in a mounted state, wherein an outlet pipe and an inlet pipe are arranged on said housing. Such muffler units are used, for example, for internal combustion engines of motor vehicles. Above all, the use of the muffler unit in an exhaust tract of the internal combustion engine is known in this connection. Moreover, a muffler may be arranged in modern internal combustion engines in a fresh air tract or in an intake tract of the internal combustion engine.

A muffler, which comprises a two-part housing with first and second housing parts of a shell-like design each, which housing forms a cavity for receiving a gas in a mounted state, is known from EP 1 691 050 A1. An outlet opening and an inlet opening are provided in this case in the housing, said inlet opening being arranged partly in both the first housing part and the second housing part. The outlet opening is correspondingly also arranged likewise partly in both the first housing part and the second housing part. The outlet or inlet opening is consequently arranged between the two housing parts and is partly enclosed by both housing parts. The muffler comprises, furthermore, an outlet bottom and an inlet bottom, which are arranged in the outlet opening and the inlet opening, respectively. To embody different configurations in terms of the number and position of inlet openings for feeding gas into the muffler, only the inlet bottom must be adapted, while the first and second housing parts may remain unchanged. This correspondingly also applies to the outlet bottom and to outlet openings arranged in this for removing exhaust gas from the muffler unit. In addition, a relatively complicated and error-prone welding of an outlet or inlet pipe arranged directly in the outlet opening or inlet opening to the first and second housing parts (i.e., in the area of the partition between the first and second housing parts) can be avoided. As so-called T joints are prepared during welding into larger cross sections due to the use of a separate inlet bottom and outlet bottom, the strength of the housing is especially high after welding together the two housing parts. Different muffler types, which can be adapted especially to different exhaust systems, can thus be embodied at a relatively low cost.

SUMMARY OF THE INVENTION

The present invention pertains to an object of providing an improved embodiment for a muffler of the type described in the introduction, especially in respect to the fastening of a bottom in an opening in the housing of the muffler.

According to the invention, a muffler unit, especially for a motor vehicle, has a two-part housing with first and second housing parts each of a shell-like design. An outlet opening and an inlet opening are provided in the housing. An outlet bottom and an inlet bottom are inserted into the outlet opening and into the inlet opening, respectively. The outlet bottom and the inlet bottom are designed each as a cover that can be inserted into outlet opening and inlet opening.

The present invention is based on the general idea that the outlet bottom and the inlet bottom are designed each as covers that can be inserted into the outlet opening and onto the inlet opening. This makes possible an especially stable and hence reliable fastening of the inlet bottom and outlet bottom on the inlet opening and outlet opening, respectively. Different structural shapes of muffler units can thus be manufactured according to the present invention at a comparatively low cost due to the use of outlet and inlet bottoms that can be easily adapted to different exhaust systems, with both the outlet bottom and the inlet bottom being at the same time fastened to the housing parts in a mechanically highly stable and reliable manner. In particular, various types of mechanically highly stable structural shapes of muffler units can be embodied in the manner of a modular system.

The outlet opening and the inlet opening preferably have, extending peripherally along an outer circumference, an outlet collar and an inlet collar, respectively, which project outwardly from the housing, with the outlet bottom and the inlet bottom having an outlet bottom collar and an inlet bottom collar, respectively, which are complementary to the respective outlet collar and inlet collar. The mechanical stability and hence also the reliability of the fastening of the outlet bottom and inlet bottom in the respective outlet opening and inlet opening can be improved in this manner.

To further increase the reliability of fastening, an outer circumferential surface of the outlet bottom collar may be in contact with an inner circumferential surface of the outlet collar at least partly or/and an outer circumferential surface of the inlet bottom collar may be in contact with an inner circumferential surface of the inlet collar at least partly in a mounted state of the muffler unit according to another embodiment variant.

It is conceivable in another embodiment variant that in the mounted state, the outer circumferential surface of the outlet bottom collar is welded to the inner circumferential surface of the outlet collar or/and to an end section of the outlet collar, and that the outer circumferential surface of the inlet bottom collar is welded to the inner circumferential surface of the inlet collar or/and to an end section of the inlet collar.

In another embodiment variant, the outer bottom may have at least one passage opening for receiving at least one outlet pipe or/and the inlet bottom may have at least one passage opening for receiving at least one inlet pipe. According to this embodiment, both the number and the particular position of the outlet pipes to be arranged in the outlet bottom and of the inlet pipes arranged in the inlet bottom can be varied depending on the use of the muffler unit.

In an especially preferred embodiment, the at least one outlet pipe is arranged, especially by means of welding in the at least one passage opening of the outlet bottom, or/and at least one inlet pipe is arranged, especially by means of welding, in the at least one passage opening of the inlet bottom.

To simplify the assembly of the muffler unit according to the present invention, the outlet opening may be provided in another preferred embodiment partly in both the first housing part and the second housing part, and the inlet opening may be arranged partly in both the first housing part and the second housing part. The outlet opening and inlet opening can thus be inserted into the first housing part before this is connected to the second housing part.

The first housing part or/and the second housing part is manufactured from an austenitic material or/and a ferritic material in an especially preferred embodiment.

Furthermore, it is conceivable that a wall thickness of the first or/and second housing part is between 0.8 mm and 3.0 mm and preferably 1.0 mm in a preferred embodiment. This makes it possible to manufacture the muffler unit according to the present invention as a lightweight construction.

The muffler unit is preferably designed such that it has a first natural frequency of at least 200 Hz and preferably at least 300 Hz in a mounted state. An especially effective muffling is possible in this manner by means of the muffler unit.

The present invention pertains, furthermore, to an exhaust system for a motor vehicle, comprising a muffler unit with one or more of the above-mentioned features, a feed line fluidically connected to the muffler unit for feeding exhaust gas into the muffler unit and an exhaust line fluidically connected to the muffler unit for removing exhaust gas from the muffler unit.

It is apparent that the above-mentioned features, which will also be explained below, can be used not only in the particular combination indicated, but in other combinations or alone as well without going beyond the scope of the present invention.

Preferred exemplary embodiments of the present invention are shown in the drawings and will be explained in more detail in the following description, in which identical reference numbers designate identical or similar or functionally identical components. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1A:
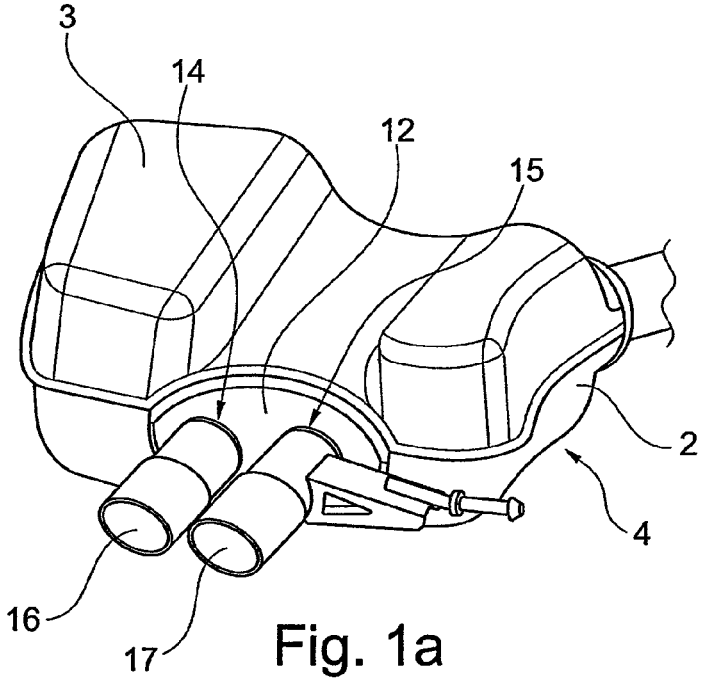
FIG. 1*a* is a schematic perspective view showing an exemplary embodiment of a muffler unit according to the present invention.
Figure 1B:
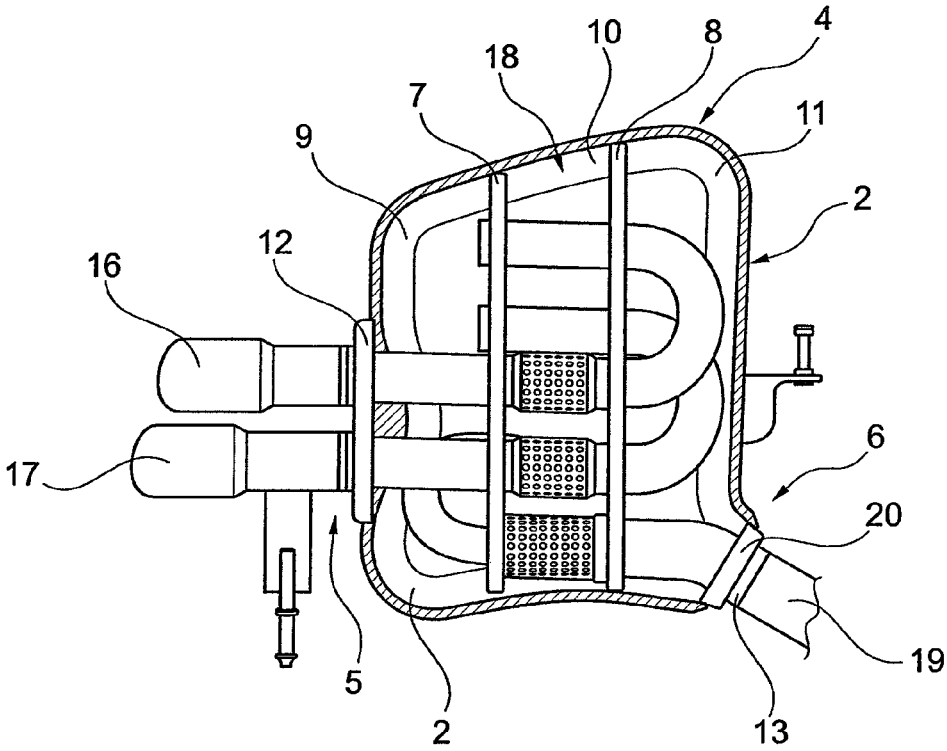
FIG. 1*b* is a schematic sectional view showing the exemplary embodiment of the muffler unit according to FIG. 1*a*.

Referring to the drawings in particular, a muffler unit is designated by 1 in FIGS. 1*a* and 1*b*. The view in FIG. 1*a* shows a perspective view of the muffler unit 1 according to the present invention. FIG. 1*b* corresponds to the view in FIG. 1*a*, but with a housing cover lifted off from the housing bottom.

The muffler 1 according to the present invention comprises a two-part housing 4 with a first housing part 2 of a shell-like design, which may be designed as a housing bottom, and with a second housing part 3, which is likewise of a shell-like design and which may be designed as a housing cover (not shown in FIG. 1*b*). The first and second housing parts 2, 3 may be manufactured in variants from an austenitic or/and a ferritic material. An inlet opening 6 and an outlet opening 5 are provided in housing 4. A hot gas, especially an exhaust gas, and sound to be muffled can be fed to the muffler unit 1 through inlet opening 6.

A plurality of transverse walls, which can divide housing 4 into a plurality of partial spaces for muffling the sound entering muffler unit 1, may be arranged in housing 4. Many different variants are conceivable concerning the arrangement and the number of transverse walls. For example, two transverse walls 7 and 8, which separate an inner space of housing 4 into first, second and third partial spaces 9, 10, 11, are arranged in the exemplary embodiment shown in FIG. 1.

The muffler unit 1 according to the present invention has, moreover, an outlet bottom 12 and an inlet bottom 13, which are inserted each into the respective outlet opening 5 and inlet opening 6 in the mounted state. Two passage openings 14, 15, through which an exhaust pipe 16, 17 each may be led, are provided in the outlet bottom 12 according to the exemplary embodiment. Exhaust pipes 16, 17 may be welded to the passage openings 14, 15.

Exhaust pipes 16, 17 are passed through the transverse walls 7, 8 in housing 4 in the exemplary embodiment and form a muffling structure 18 together with transverse walls 7, 8.

A passage opening 20, through which a feed pipe 19 is passed, is likewise provided in inlet bottom 13. Feed pipe 19 may be welded to inlet bottom 13. Feed pipe 19 is fastened in housing 4 to the transverse walls 7, 8 and passed through these. Feed pipe 19 is thus also part of muffling structure 18.

It is clear that numerous variants, especially concerning the number of transverse walls, the arrangement thereof in housing 4 and also concerning the arrangement and fastening of feed and exhaust pipes in housing 4 are possible concerning the concrete technical embodiment of muffling structure 18. It is likewise clear that both the number of feed pipes and the respective positions thereof in outlet bottom 12 may vary in variants. This also applies, with the necessary modifications, to the number and position of the exhaust pipes in inlet bottom 13.

Outlet bottom 12 and inlet bottom 13 are each designed according to the present invention as covers 21 inserted into outlet opening 5 and inlet opening 6. This is shown for illustration in a highly schematic view in FIG. 2, which will be explained below.

Figure 2:
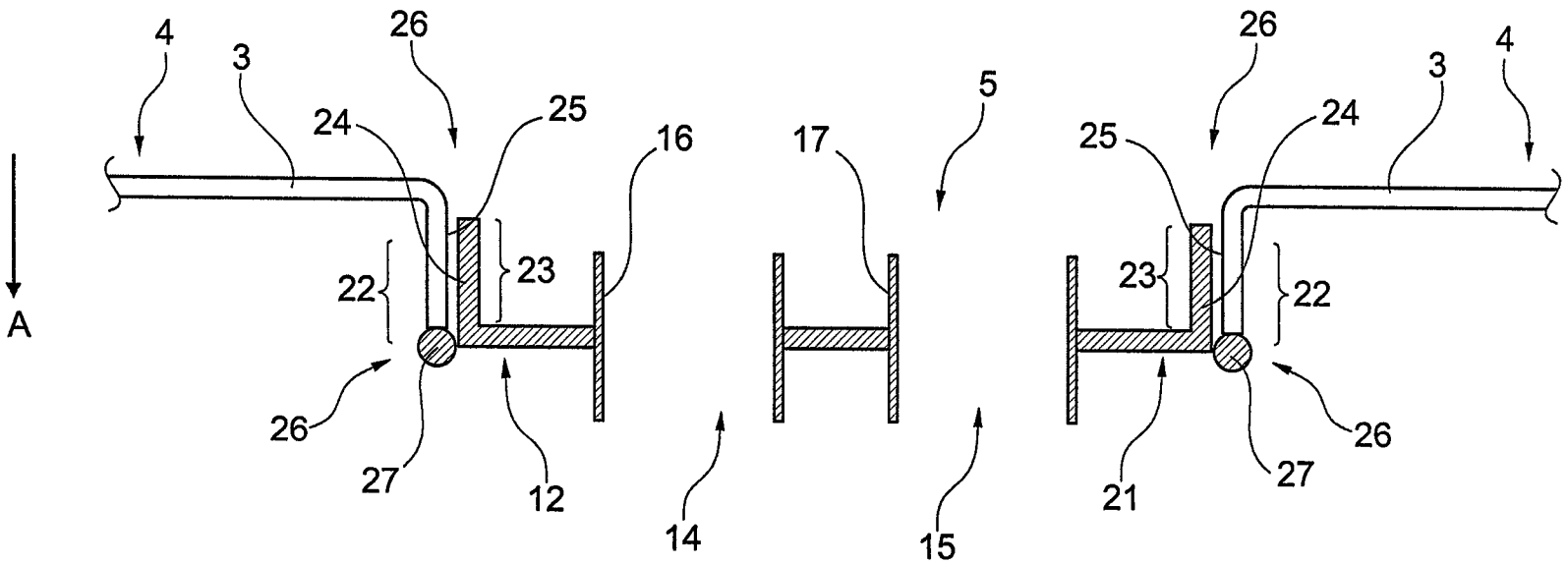
FIG. 2 is a highly schematic partial view of the muffler unit according to FIG. 1*a*.

FIG. 2 shows in a highly schematic sectional view the second housing part 3 designed as a bottom, in which outlet opening 5 is provided. Outlet bottom 12 designed as a cover 21 is inserted into outlet opening 5. Outlet bottom 12 has the passage openings 14, 15, through which exhaust pipes 16, 17 are led. Exhaust pipes 16, 17 are welded to outlet bottom 12, as was already explained above. Outlet opening 5 has an outlet collar 22, which extends around an outer circumference and projects outwardly (arrow A in FIG. 2). Outlet bottom 12 correspondingly has an outlet bottom collar 23 complementary to outlet collar 22.

In the mounted state of outlet bottom 12 shown in FIG. 2, an outer circumferential surface 24 of outlet bottom collar 23 is in contact with an inner circumferential surface 25 of outlet collar 22. Outer circumferential surface 24 may be welded to inner circumferential surface 25 for stable fastening of cover 21 to housing 4. As an alternative or in addition, outer circumferential surface 24 may also be welded to an end section 26 of outlet collar 22 enclosing outlet collar 22. A corresponding weld seam is designated by reference number 27 in FIG. 2.

The explanations concerning the stable fastening of outlet bottom 12 designed as cover 21 to outlet opening 5, which is shown in a highly schematic manner in FIG. 2, are correspondingly also applicable to the fastening of an inlet bottom 13 likewise designed as a cover to inlet opening 6 (cf. FIG. 1).

In a preferred variant of the exemplary embodiment, outlet opening 5 may be provided partly in both the first and second housing parts 2, 3 and inlet opening 6 may be provided partly in both the first and second housing parts 2, 3. The mounting of the muffler unit 1 according to the present invention can be substantially simplified in this manner. To mount muffler unit 1, outlet bottom 12 can thus be inserted into outlet opening 5 and inlet bottom 13 into inlet opening 6 before welding the first housing part 2 to the second housing part 3.

A wall thickness of the first or/and second housing parts 2, 3 is between 0.8 mm and 3.0 mm, but preferably 1.0 mm in preferred variants of the exemplary embodiment. The natural frequency of muffler unit 1 preferably has a first natural frequency of at least 200 Hz and most preferably at least 300 Hz in the mounted state. Muffler unit 1 according to the exemplary embodiment may be connected to an exhaust system for a motor vehicle (not shown in FIGS. 1 and 2). Such an exhaust system now comprises a feed line fluidically connected to muffler unit 1 for feeding exhaust gas into muffler unit 1 and an exhaust line fluidically connected to muffler unit 1 for removing exhaust gas from muffler unit 1.

While specific embodiments of the invention have been shown and described in detail to illustrate the application of the principles of the invention, it will be understood that the invention may be embodied otherwise without departing from such principles.

What is claimed is:

1. A muffler unit for a motor vehicle, the muffler unit comprising:

a two-part housing comprising a first housing part of a shell-like design and a second housing part of a shell-like design, wherein an outlet opening and an inlet opening are provided in the housing;

an outlet bottom inserted into the outlet opening as an outlet opening cover with an outlet cover portion extending in a radial direction of the outlet opening, the outlet cover portion having an outlet cover radial dimension that is greater than an outlet cover axial dimension; and an inlet bottom inserted into the inlet opening as an inlet opening cover with an inlet cover portion extending in a radial direction of the inlet opening, the inlet cover portion having an inlet cover radial dimension that is greater than an axial dimension.

2. A muffler unit in accordance with claim 1, wherein:

the outlet opening has an outlet collar extending circumferentially along an outer circumference, which projects outwardly from a remainder of the housing in an axial direction of the outlet opening;

the inlet opening has an inlet collar extending circumferentially along the outer circumference, which projects outwardly from a remainder of the housing in an axial direction of the inlet opening;

the outlet bottom has an outlet bottom collar that is complementary to the outlet collar and extends in the axial direction of the outlet opening, the outlet bottom collar having an outlet bottom collar axial dimension that is greater than an outlet bottom collar radial dimension;

the inlet bottom has an inlet bottom collar which is complementary to the inlet collar and extends in the axial direction of the inlet opening, the inlet bottom collar having an inlet bottom collar axial dimension that is greater than an outlet bottom collar radial dimension.

3. A muffler unit in accordance with claim 2, wherein in a mounted state of the muffler unit:

an outer circumferential surface of the outlet bottom collar is at least partly in contact with an inner circumferential surface of outlet collar; and an outer circumferential surface of the inlet bottom collar is at least partly in contact with an inner circumferential surface of the inlet collar.

4. A muffler unit in accordance with claim 3, wherein in the mounted state of the muffler unit:

the outer circumferential surface of the outlet bottom collar is welded to the inner circumferential surface of the outlet collar or/and to an end section of the outlet collar; and the outer circumferential surface of the inlet bottom collar is welded to the inner circumferential surface of the inlet collar or/and to an end section of the inlet collar.

5. A muffler unit in accordance with claim 1, further comprising:

an outlet pipe; and an inlet pipe, wherein:

the outlet cover portion of the outlet bottom has at least one passage opening for receiving the outlet pipe; and the inlet cover portion of the inlet bottom has at least one passage opening for receiving the inlet pipe.

6. A muffler unit in accordance with claim 1, further comprising:

an outlet pipe; and an inlet pipe, wherein:

the outlet cover portion of the outlet bottom has at least one outlet pipe passage opening; and the inlet cover portion of the inlet bottom has at least one inlet pipe passage opening;

the outlet pipe is arranged, by means of welding, in the outlet pipe passage opening, extending from within the housing, through the outlet cover portion, to an exterior of the housing; and the inlet pipe is arranged, by means of welding, in the inlet pipe passage opening, extending from within the housing, through the inlet cover portion, to an exterior of the housing.

7. A muffler unit in accordance with claim 1, wherein:

the outlet opening is provided partly in both the first housing part and in the second housing part; and the inlet opening is provided partly in both the first housing part and in the second housing part.

8. A muffler unit in accordance with claim 1, wherein at least one of the first housing part first and the second housing part is manufactured from an austenitic material or/and a ferritic material.

9. A muffler unit in accordance with claim 1, wherein a wall thickness of the first or/and second housing part is between 0.8 mm and 3.0 mm.

10. A muffler unit in accordance with claim 1, wherein the muffler has a first natural frequency of at least 200 Hz in a mounted state.

11. A muffler unit in accordance with claim 1, wherein:

the outlet opening has an outlet collar with an outlet opening projecting annular portion extending circumferentially along an outlet opening outer circumference and projecting outwardly from a remainder of the housing;

the inlet opening has an inlet collar with an inlet opening projecting annular portion extending circumferentially along an inlet opening outer circumference and projecting outwardly from a remainder of the housing;

the outlet bottom has an outlet bottom collar with an outlet cover projecting annular portion extending circumferentially along an outer circumference of the outlet cover portion and extending axially, the outlet cover projecting annular portion being complementary to the outlet collar, the outlet bottom collar having an outlet bottom collar axial dimension that is greater than an outlet bottom collar radial dimension;

the inlet bottom has an inlet bottom collar with an inlet cover projecting annular portion extending circumferentially along an outer circumference of the inlet cover portion and extending axially, the outlet cover projecting annular portion being complementary to the inlet collar, the inlet bottom collar having an inlet bottom collar axial dimension that is greater than an outlet bottom collar radial dimension;

an outer circumferential surface of the outlet bottom collar is at least partly in contact with an inner circumferential surface of outlet collar;

an outer circumferential surface of the inlet bottom collar is at least partly in contact with an inner circumferential surface of the inlet collar;

the outer circumferential surface of the outlet bottom collar is welded to the inner circumferential surface of the outlet collar or/and to an end section of the outlet collar; and the outer circumferential surface of the inlet bottom collar is welded to the inner circumferential surface of the inlet collar or/and to an end section of the inlet collar.

12. An exhaust system for a motor vehicle, the exhaust system comprising:

a muffler unit comprising a first housing part of a shell-like design and a second housing part of a shell-like design cooperating to form a housing, wherein an outlet opening and an inlet opening are provided in the housing, an outlet bottom inserted into the outlet opening as an outlet opening cover with an outlet cover portion extending in a radial direction of the outlet opening, the outlet cover portion having an outlet cover radial dimension greater than an outlet cover axial dimension and an inlet bottom inserted into the inlet opening as an inlet opening cover with an inlet cover portion extending in a radial direction of the inlet opening, the inlet cover portion having an inlet cover radial dimension greater than an axial dimension a feed line fluidically connected to the muffler unit for feeding exhaust gas into the muffler unit; and an exhaust line fluidically connected to the muffler unit for removing exhaust gas from the muffler unit.

13. An exhaust system in accordance with claim 12, wherein:

the outlet opening has an outlet collar extending circumferentially along an outer circumference, which projects outwardly from a remainder of the housing in an axial direction of the outlet opening;

the inlet opening has an inlet collar extending circumferentially along the outer circumference, which projects outwardly from a remainder of the housing in an axial direction of the inlet opening;

the outlet bottom has an outlet bottom collar that is complementary to the outlet collar and extends in the axial direction of the outlet opening, the outlet bottom collar having an outlet bottom collar axial dimension that is greater than an outlet bottom collar radial dimension;

the inlet bottom has an inlet bottom collar which is complementary to the inlet collar and extends in the axial direction of the inlet opening, the inlet bottom collar having an inlet bottom collar axial dimension that is greater than an outlet bottom collar radial dimension.

14. An exhaust system in accordance with claim 13, wherein:

an outer circumferential surface of the outlet bottom collar is at least partly in contact with an inner circumferential surface of outlet collar;

an outer circumferential surface of the inlet bottom collar is at least partly in contact with an inner circumferential surface of the inlet collar;

the outer circumferential surface of the outlet bottom collar is welded to the inner circumferential surface of the outlet collar or/and to an end section of the outlet collar; and the outer circumferential surface of the inlet bottom collar is welded to the inner circumferential surface of the inlet collar or/and to an end section of the inlet collar.

15. An exhaust system in accordance with claim 12, further comprising:

an outlet pipe; and an inlet pipe, wherein:

the outlet cover portion of the outlet bottom has at least one passage opening for receiving the outlet pipe, which extends from within the housing, through the outlet cover portion, to an exterior of the housing; and the inlet cover portion of the inlet bottom has at least one passage opening for receiving the inlet pipe, which extends from within the housing, through the inlet cover portion, to an exterior of the housing.

16. An exhaust system in accordance with claim 12, wherein:

the outlet opening is provided partly in both the first housing part and in the second housing part; and the inlet opening is provided partly in both the first housing part and in the second housing part.

17. An exhaust system in accordance with claim 12, wherein at least one of the first housing part and the second housing part is manufactured from an austenitic material or/and a ferritic material.

18. An exhaust system in accordance with claim 12, wherein a wall thickness of the first housing part or/and second housing part is between 0.8 mm and 3.0 mm.

19. An exhaust system in accordance with claim 12, wherein the muffler has a first natural frequency of at least 200 Hz in a mounted state.

20. A motor vehicle muffler unit comprising:

a first housing part shell;

a second housing part shell, the first housing part shell being connected to the second housing part shell to form a housing with an interior space and with an outlet opening and with an inlet opening;

an outlet bottom inserted into the outlet opening as an outlet opening cover comprising an outlet cover portion extending across the outlet opening in a radial direction of the outlet opening, the outlet cover portion having an outlet cover portion radial dimension that is greater than an outlet cover portion axial dimension, the outlet cover portion defining at least one outlet pipe passage opening;

an inlet bottom inserted into the inlet opening as an inlet opening cover comprising an inlet cover portion extending across the inlet opening in a radial direction of the inlet opening, the inlet cover portion having an inlet cover portion radial dimension that is greater than an inlet cover portion axial dimension, the inlet cover portion defining an outlet pipe passage opening;

an outlet pipe received in the outlet pipe passage opening and extending from within the interior space, through the outlet cover portion, to an exterior of the housing; and an inlet pipe received in the inlet pipe passage opening and extending from within the interior space, through the inlet cover portion, to an exterior of the housing.

* * * * *